US005537803A

United States Patent [19]

Olsén

[11] Patent Number: 5,537,803

[45] Date of Patent: Jul. 23, 1996

[54] METHOD AND APPARATUS FOR FINISHING AND FILLING PACKAGING CONTAINERS

[75] Inventor: Jan-Erik Olsén, Ystad, Sweden

[73] Assignee: Tetra Laval Holdings & Finance S.A., Pully, Switzerland

[21] Appl. No.: 383,579

[22] Filed: Feb. 3, 1995

[30] Foreign Application Priority Data

Feb. 15, 1994 [SE] Sweden ..... 9400506

[51] Int. Cl.[6] ..... B65B 5/04

[52] U.S. Cl. ..... 53/467; 53/381.1; 53/235

[58] Field of Search ..... 53/467, 469, 471, 53/235, 468, 381.2; 141/5, 6, 10, 39, 40, 44, 45, 57, 64

[56] References Cited

U.S. PATENT DOCUMENTS

| | | | |
|---|---|---|---|
| 3,321,887 | 5/1967 | Manas | 53/467 |
| 3,650,774 | 3/1972 | Beth et al. | 53/467 |
| 3,945,174 | 3/1976 | Franz . | |
| 4,452,030 | 6/1984 | Inada . | |
| 4,530,202 | 7/1985 | Powell et al. | 141/57 |
| 4,860,802 | 8/1989 | Yamaguchi et al. | 141/6 |
| 4,860,804 | 8/1989 | Yamaguchi et al. | 141/40 |
| 4,869,047 | 9/1989 | Nishiguichi et al. . | |
| 4,942,716 | 7/1990 | Anderson | 53/381.2 |
| 5,163,487 | 11/1992 | Clüsserath | 141/39 |

FOREIGN PATENT DOCUMENTS

| | | |
|---|---|---|
| 1-139302 | 5/1989 | Japan . |
| 454679 | 5/1988 | Sweden . |
| 2073131 | 10/1981 | United Kingdom . |

*Primary Examiner*—John Sipos
*Assistant Examiner*—Ed Tolan
*Attorney, Agent, or Firm*—Burns, Doane, Swecker & Mathis

[57] ABSTRACT

The present invention relates to a method of finishing and filling packaging containers which are manufactured from foldable packaging material and which have previously been sealed and are preferably sterilized interiorly and have been transported in a flat-laid state to, for example, a food producer. The prefabricated, compressed packaging containers are connected to a piston pump which, with the aid of an overfill operation, expands and forms the packaging container, whereafter a proportion of the contents of the packaging container is resucked out of the container so that the packaging container holds a predetermined nominal volume of contents. Hereafter, the packaging container is sealed and finally formed into the desired configuration, such as a parallelepipedic configuration. An apparatus for finishing and filling packaging containers is also disclosed.

20 Claims, 2 Drawing Sheets

METHOD AND APPARATUS FOR FINISHING AND FILLING PACKAGING CONTAINERS

TECHNICAL FIELD

The present invention relates to a method of finishing and filling packaging containers manufactured from foldable packaging material.

BACKGROUND

Consumer packages for liquid or pumpable foods such as, for example, milk, stewed fruits, blancmanges or tomato purée are often manufactured from foldable packaging material, for example packaging laminates comprising layers of fibrous material, aluminium foil and thermoplastic, which are fed in web or sheet form into packaging machines which, by folding, sealing and form-processing, convert the material into filled, sealed packaging containers. Packaging containers for long shelf life use, so-called aseptic packages, may be produced in that both the packaging material and the product are sterilized prior to finishing of the packages. Modern packaging machines of the above-outlined type work at a very high production output rate and, as a result, the packaging machines are relatively large and best suited for large-scale industrial production.

In the packing of foods which are produced on a limited scale or for a limited period of time, for example seasonal produce such as tomato purée and olive oil, tradition calls for the employment of glass bottles, jars or tubes which are delivered ready-to-use and are filled in relatively rudimentary filling machines either directly at or close to the food producers. No aseptic filling systems of this type are available, and when it is desired to impart long shelf life to the packed product, known preserving methods such as autoclaving are employed. Machines for blowing aseptic plastic bottles on site at the food producer are also known in the art, but have proved to be difficult to operate in a satisfactory manner from the aseptic point of view. Previously sterilized plastic bottles or other packaging containers are, of course, also conceivable, but the transport of empty prefabricated packaging containers is a drain on resources because of the large unutilised volumes involved.

It will be apparent from the foregoing introduction that there is a need for producing specifically aseptic packaging containers of the single-use disposable type which are simple and efficient to transport and well-suited for local handling and filling on a small scale at individual food producers. The packaging container must be capable of being transported in a space-efficient manner and it is therefore also desirable to realise a method which makes it possible to expand a compressed or flat-laid packaging container in connection with the filling process. It is finally also desirable in the art that products which have been sterilized beforehand, for example by heat treatment, can be packed under aseptically reliable conditions in order to ensure that the finished package will have the desired long shelf life.

SUMMARY OF THE INVENTION

One object of the present invention is to realise a method of finishing and filling packaging containers manufactured from foldable packaging material, the method obviating the above-outlined drawbacks and making for rational, hygienic and possibly aseptic packing of relatively small product volumes direct on site at the food producers.

A further object of the present invention is to realise a method of finishing and filling packaging containers, the method obviating the need for complicated, bulky and expensive packaging machines which are difficult to run and maintain.

Still a further object of the present invention is to realise a method of finishing and filling packaging containers, the method making for simple and efficient handling and filling of prefabricated packaging containers with limited volumes of product of various viscosities and compositions, for example juice, wine, olive oil or tomato purée.

Yet a further object of the present invention is, finally, to realise a method of finishing and filling packaging Containers, the method being reduced into practice even with limited financial or human resources.

The above and other objects have been attained according to the present invention in that a method of finishing and filling packaging containers manufactured from foldable packaging material has been given the characterizing feature that prefabricated, compressed packaging containers are connected to a conduit for contents via which contents are fed into the packaging container until the packaging container has assumed expanded form, whereafter contents are resucked out of the container until the volume of the container corresponds to a predetermined quantity of contents, the packaging container then being sealed.

By ensuring, according to the invention, that the contents themselves are utilised for expanding prefabricated, flat-laid packaging containers to their desired configuration, a production process is made possible which obviates the need for complicated forming methods and the associated complex and expensive production machinery. The necessary complete expansion of the package is guaranteed by a certain overfilling of contents, which is then resucked out of the packaging container so that the nominal volume of the packaging container can be achieved with a high degree of accuracy. The supply of packaging containers in the sealed, sterile state and filling under aseptic conditions ensure that the finished packaging containers will have long shelf life even though no sterilization of the packaging containers is necessary in connection with filling on site at the food producers.

BRIEF DESCRIPTION OF THE ACCOMPANYING DRAWINGS

One preferred embodiment of the method according to the present invention will now be described in greater detail hereinbelow, with particular reference to the accompanying schematic Drawings which show only those details essential to an understanding of the invention. In the accompanying Drawings.

Figure 3:
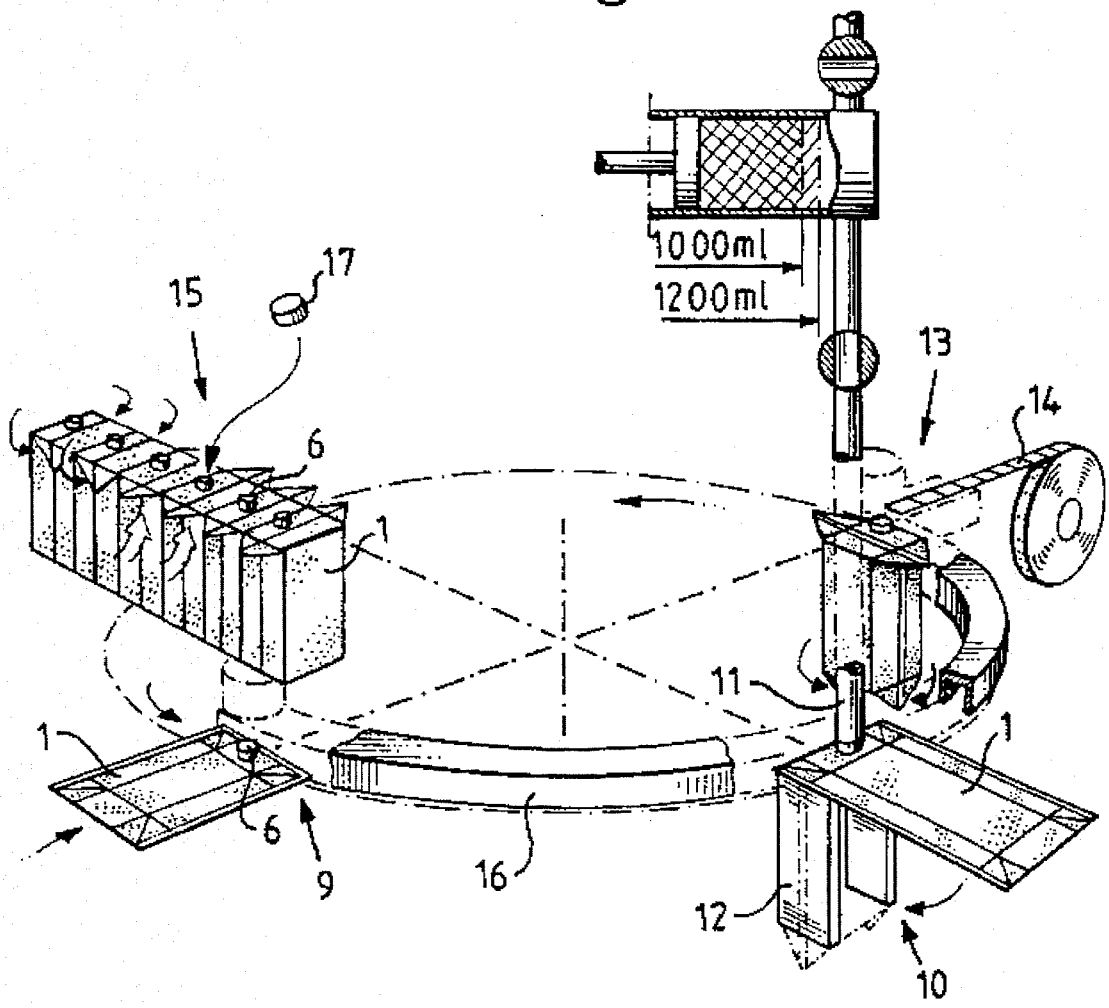
Figure 4:
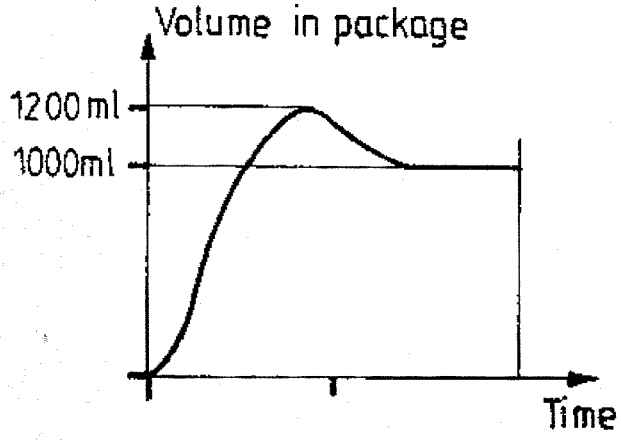

FIG. 3 schematically illustrates in steps the finishing and filling of the packaging container using the method according to the present invention; and FIG. 4 illustrates, in diagram form, a preferred forming and filling cycle according to the present invention.

DESCRIPTION OF PREFERRED EMBODIMENT

Figure 1:
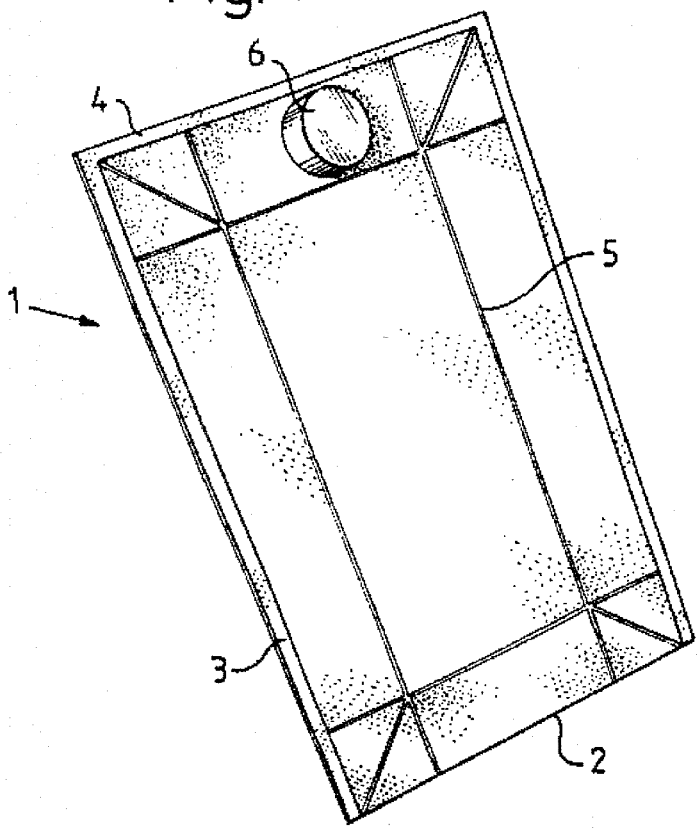
FIG. 1 shows, in the flat-laid state, a packaging container of the type which is intended to be handled using the method according to the invention.

One preferred embodiment of a packaging container which is intended to be employed in connection with the method according to the present invention is illustrated in FIG. 1 and consists of a foldable, flexible packaging material of per se known type. The packaging material is a laminate which comprises a substantially central carrier or core layer of fibrous material, for example paper, which is coated on either side with homogeneous layers of thermoplastic material, for example polyethylene. The polyethylene layers impart to the packaging material the desired liquid tightness and moreover make it possible to heat-seal (fuse) the material. In those cases when reinforced light or gas barrier properties are desired, the packaging laminate also includes a layer of aluminium foil or other barrier material, this being connected to the fibrous material by means of an additional layer of thermoplastic.

FIG. 1 shows the packaging container in the compressed or flat-laid state, which makes it suitable for space-saving transport, for example from the site of manufacture to the food producer where the packaging container is to be finished and filled with the contemplated contents. The packaging container 1 is produced in that a sheet of packaging material is folded double along a bottom line 2, whereafter the longitudinal and transverse edges of the sheet are heat-sealed inside-to-inside in two mutually parallel, longitudinal joint seams 3 and one transverse joint seam 4. The packaging material is also provided with a pattern of folding or crease lines 5 which make it possible, in a per se known manner, to convert the packaging blank into a substantially parallelepipedic package form, as will be described in greater detail hereinbelow. At the upper end of the packaging container 1, the one side of the flat-laid blank displays an opening arrangement 6 which preferably consists of a projecting, tubular plastic portion which is covered with a lid or a plastic film.

Figure 2:
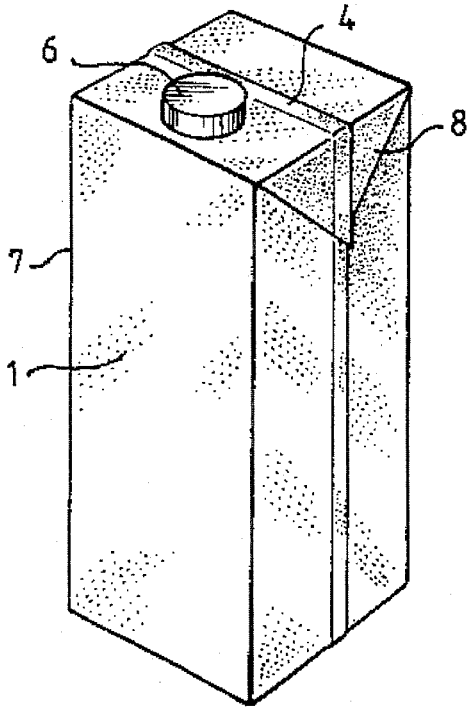
FIG. 2 shows the packaging container of FIG. 1 after filling and final forming.

It will be apparent from FIG. 2 how the packaging container 1, after filling and sealing, has obtained its parallelepipedic configuration, the crease or fold lines 5 controlling the formation of the longitudinal and transverse edge lines 7 of the packaging container and also making possible the formation of four flat-laid corner flaps 8 for taking up the surplus material which, for geometric reasons, arises on the reforming of the flat-laid packaging container into its parallelepipedic final form. Two upper corner flaps 8 are folded down towards and sealed to the sides of the packaging container, while two bottom corner flaps (not visible) are folded in towards and heat-sealed to the bottom of the packaging container. It will also be apparent from FIG. 2 how the opening arrangement is, after reforming of the packaging container, placed at the relatively planar upper surface of the packaging container between one of the edge lines 7 and the transverse seam 4 running centrally across the upper surface of the packaging container.

When the method according to the present invention is reduced into practice, the point of departure is thus the illustrated type of packaging container 1, or some other type of packaging container which may, after manufacture and sealing, be compressed or flat-laid in the empty state so that it can be transported economically. On manufacture of aseptic packages, the packaging container must, of course, also be sterilized, which takes place in connection with or after the manufacture of the packaging container, for example in a conventional manner by chemical sterilization or by radiation sterilization. The empty, compressed packaging containers are then transported in suitable shipment containers, for example shrink-film wrapped paperboard cartons or the like and are delivered in this form direct to the food producer. A packaging machine is located at the food producer's, or, for example, at some local packaging firm, which makes it possible to finish and fill the prefabricated packaging containers in accordance with the present invention. The principle of such a machine is shown in FIG. 3 which, at the same time, illustrates in steps how the method according to the invention may be put into effect when packaging containers according to FIGS. 1 and 2 are to be filled with previously sterilized contents, for example heat-treated juice. Naturally, the method is also suitable for the production of non-aseptic packages and then proceeds fundamentally in the same manner, apart from the fact that the apparatuses and functions necessary for maintaining sterility may be dispensed with. The method according to the invention will be described below as it is formulated in the production of aseptic packages with long shelf life.

Packaging containers 1 are fed in the flat-laid state into an infeed station 9 which, for example, by means of a conveyor (not shown), may be directly or indirectly connected to a magazine for flat-laid packaging containers 1, or alternatively be supplied manually with packaging containers direct from the shipment carton in which the packaging containers were delivered. The packaging containers are, as mentioned above, previously treated in such a manner that they display a sterile interior, for example by radiation sterilization or by treatment with conventional sterilization agents such as hydrogen peroxide. The packaging containers 1 are fed in with the sealed opening arrangements 6 directed forwards and upwards.

After infeed, each packaging container is displaced to a filling and forming station 10 at which a filler pipe 11 extends substantially vertically downwards to that point where the opening arrangement 6 of an advanced packaging container will be placed. The filler pipe 11 is connected to a suitable pump of per se known design and construction, for example a piston pump which in turn is in communication with a storage vessel for the product which is to be packed. The product has been previously sterilized, for example by heat treatment, and the product vessel, filler pipe and piston pump must therefore be of the bacteria-tight and aseptic types.

A sterile tunnel 16 extends between the infeed station 9 and the sealing station 13, respectively, the sterile tunnel being fed in a known manner with sterile air so that a certain excess pressure prevails. The tunnel is provided at both ends with sluices in order to make possible infeed and discharge, respectively, of the packaging containers without impairing the level of sterility. In the illustrated embodiment, the tunnel covers only that end of the packaging container which is fitted with an opening arrangement, but the tunnel may of course also be designed so that the entire packaging container is fed through the tunnel.

When a packaging container 1 has been placed in the filling and forming station 10, its forward end is raised until the opening arrangement 6 comes into contact with and sealingly abuts against the lower end of the filler pipe 11. With the aid of, for instance, a cutting device located in the filler pipe, the upper surface or plastic membrane of the opening arrangement 6 is penetrated (this penetration may also take place when the opening arrangement passes into the sterile tunnel 16 on its way from station 9 to station 10), whereafter the piston pump is activated and, with a certain excess pressure, feeds in the desired quantity of contents into the packaging container. As a result of infeed of contents, the packaging container expands from being substantially flat-laid to being substantially cushion-shaped, where its volume exceeds the predetermined quantity of contents (nominal volume) which the finished packaging container is intended to hold. As a result of this overfill, which amounts to 110–140% of the nominal volume of the package, it will be ensured that the package is expanded so that undesired crease formation is avoided and the package is partly reformed and folded in the weakened fold or crease lines 5. The filling of the package to maximum volume takes approximately half a second and is immediately followed by resuction of a certain portion of the contents so that the package contents accurately correspond to the nominal quantity of contents which the package is to hold. The resuction is effected in that the piston of the piston pump executes a limited return stroke which preferably amounts to approximately 20% of the total stroke (see FIG. 3). On the expansion and forming of the packaging container, reforming of the packaging container into substantially parallel-epipedic form is facilitated in that the packaging container is pivoted through approximately 90° downwards (indicated in FIG. 3), at the same time as it is given quadrilateral cross-section with the aid of forming plates 12 located on either side of the packaging container, the plates being, in the final phase of the filling cycle, located at such a distance from one another that the packaging container obtains the desired cross-sectional configuration.

After completed filling and forming cycle, the packaging container is displaced from the station 10 to a sealing station 13 in which the opening arrangement 6 of the packaging container penetrated by the filler pipe 11 is once again closed and sealed with the aid of a heat-sealable plastic strip 14 which is applied over the opening arrangement 6 and is heat-sealed thereto in a bacteria and liquid-tight manner. The plastic strip 14 may also contain a layer of aluminium foil. Transport of the packaging container from the station 10 to the sealing station 13 takes place with at least the opening arrangement 6 enclosed in the sterile tunnel 16 which, in a conventional manner, is provided with sluice device at the infeed and discharge ends and which, in a similarly known manner, is kept under a gentle excess pressure by the aspiration of sterile gas. While the packaging container is located in the sealing station 13, a certain forming processing also takes place of the lower end of the packaging container, in that the bottom flaps 8 located here are pressed flat and folded in towards and sealed to the lower end of the packaging container. This operation takes place in a known manner and the fixed sealing of the flaps is effected either by the application of a suitable adhesive or bonding agent, for example hot melt glue, or by the external thermoplastic layer of the packaging material being utilised for heat sealing the flaps to the bottom surface of the packaging container.

After the above-described handling, the packaging container 1 is once again displaced from the sealing station 13 to a discharge station 15 in which the packaging container is placed on a discharge path or conveyor. Finishing of the upper end of the packaging container here takes place in that both of the corner flaps located at the upper end are pressed flat and folded down and sealed to both vertical end walls of the packaging container, this being effected in basically the same manner as the previously mentioned handling and forming of the bottom end of the container. If desired, the packaging container may, while located in the discharge station, also be provided with some form of lid covering the opening arrangement 6 or a screw cap 17, which makes possible reclosure of the packaging container once the top provided by the plastic strip 14 has been removed. The packaging container is thereafter ready for transport from the forming and filling machine and further handling, for example placing in group shipment receptacles for delivery to sales points or direct to the consumer.

The principle of utilising a prefabricated, flat-laid and sterile packaging container which is filled through the opening arrangement of the packaging container makes it possible to simplify enormously both the finishing and filling method and the machine for carrying the method into effect. If desired, it is naturally also possible, for example, in packages with certain types of opening arrangements, to fill the package in some other way, for instance through a separate filling valve which is integral in the packaging and filling machine and which may be placed in the bottom surface of the packaging container. It will hereby be possible to provide the packaging container with more complicated forms of opening arrangements which are not suitable for employment in filling of the package. As was mentioned above, the contents may consist of, for example, liquids of different viscosities, but it is also conceivable to finish and fill packaging containers with other types of product, for example soups or beverages containing minor particles of fruit or vegetables, relatively viscous paste-like products or other products using the method according to the present invention. The packaging container produced in the above-disclosed manner will automatically be completely filled, i.e. will have no head-space, but it is of course possible to produce head-space packages in that the contents are, for example, mixed with a certain proportion of inert gas or in that a nominal quantity of contents is employed during the overfill operation, followed by the aspiration of inert gas to the desired volume, of which a certain proportion can of course be bled off after the completed forming cycle.

FIG. 4 schematically illustrates the filling cycle in the finishing and filling of a packaging container using the method according to the present invention. The illustrated type example relates to a packaging container with a nominal volume of 1 liter, and it will be apparent from the curve how the piston pump, during a time of approximately half a second, fills the packaging container with a volume of 1.2 liters, which ensures that sufficient inner pressure occurs for the packaging container to form and right itself in a suitable manner. For a further half a second, resuction takes place of the surplus contents in that the pump piston executes a limited return stroke, and consequently after a total filling time of roughly one second the packaging container holds the desired, nominal quantity of contents, at a volume of 1 liter. Depending upon the size and configuration of the packaging container, and partly in dependence upon the type of packaging material and fold or crease lines employed, the degree of overfill may need to be varied, but practical experiments have demonstrated that, in most cases, it is suitable to use an overfill level of between 110 and 140% of the nominal volume of the packaging container.

Using the method according to the invention, it will thus be possible, in a rational and economical manner, to prefabricate aseptic packaging containers which, in the closed state, are transported to, for instance, a local producer of juice where the packages are, under aseptic conditions, filled with previously sterilized juice, sealed and finished for delivery to the sales point or customer. The principle involved ensures that high standards of hygiene or alternatively high aseptic requirements can be met even under relatively primitive external conditions.

While this invention has been illustrated and described in accordance with a preferred embodiment, it is recognized that variations and changes may be made therein without departing from the invention as set forth in the claims.

What is claimed is:

1. A method of finishing and filling packaging containers manufactured from foldable packaging material to a predetermined quantity of contents and a predetermined size of container, comprising the steps of:

connecting a prefabricated, compressed packaging container to a conduit for contents;

overfeeding contents through the conduit into the packaging container until the packaging container has assumed expanded form greater than the predetermined size of the container;

sucking fed contents out of the packaging container until the size of the container corresponds to the predetermined quantity of contents and the predetermined container size; and sealing the packaging container.

2. The method as claimed in claim 1, comprising the further step of treating the packaging container to obtain a sterile interior prior to connecting the packaging container to the conduit.

3. The method as claimed in claim 1, wherein the contents are fed into the packaging container through an opening arrangement of the packaging container.

4. The method as claimed in claim 1, wherein, when contents are fed into the packaging container, the packaging container is expanded from a substantially laid-flat state to a substantially cushion-shaped state.

5. The method as claimed in claim 1, wherein, when contents are overfed into the packaging container, the packaging container is filled to 110–140% of the predetermined packaging container size.

6. The method as claimed in claim 1, wherein the contents consist of a pumpable liquid or gas.

7. The method as claimed in claim 2, comprising the further step of moving the packaging container to a filling station at which the packaging container is filled with the contents.

8. The method as claimed in claim 2, wherein the conduit for contents is connected to the packaging container under aseptic conditions and sterile contents are fed into the packaging container.

9. The method as claimed in claim 2, wherein the packaging container is sealed aseptically.

10. The method as claimed in claim 4, comprising the further step of performing external forming operations to provide the packaging container with a substantially parallelepipedic form.

11. An apparatus for finishing and filling packaging containers manufactured from foldable packaging material to a predetermined quantity of contents and a predetermined size of packaging container, comprising:

product supply means including a conduit having a filler opening, the filler opening being arranged to engage a filling opening of a packaging container;

a pump, the pump supplying product through the conduit filling opening into the packaging container until the packaging container has assumed expanded form greater than the predetermined size of the packaging container and sucking product out of the container until the size of the container corresponds to the predetermined quantity of contents and the predetermined packaging container size; and means for sealing the packaging container.

12. The apparatus as claimed in claim 11, further comprising means for treating the packaging container to obtain a sterile interior prior to connecting the packaging container to the conduit.

13. The apparatus as claimed in claim 11, wherein the pump fills the packaging container to 110–140% of the predetermined packaging container size.

14. The apparatus as claimed in claim 11, wherein the pump pumps liquid contents.

15. The apparatus as claimed in claim 11, wherein the pump pumps gaseous contents.

16. The apparatus as claimed in claim 11, further comprising means for forming the packaging container into a parallelepipedic shape.

17. The apparatus as claimed in claim 16, wherein the forming means forms the packaging container as the pump fills the packaging container.

18. The apparatus as claimed in claim 11, further comprising a cutting device for penetrating an opening arrangement on the packaging container.

19. The apparatus as claimed in claim 11, further comprising a sterile tunnel through which at least a portion of the packaging container is transported prior to being connected to the end of the conduit.

20. The apparatus as claimed in claim 11, wherein the pump is a piston pump.

* * * * *